US006344110B1

(12) United States Patent
Reiner et al.

(10) Patent No.: US 6,344,110 B1
(45) Date of Patent: Feb. 5, 2002

(54) METHOD OF PRODUCING A PAPER HAVING A THREE-DIMENSIONAL PATTERN

(75) Inventors: Lennart Reiner, Matfors; Holger Hollmark, Stockholm, both of (SE); Hans-Jürgen Lamb, Gernsheim (DE); Hans Wallenius, Ljungskile (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/597,786

(22) Filed: Jun. 19, 2000

Related U.S. Application Data

(63) Continuation of application No. PCT/SE98/02461, filed on Dec. 29, 1998.

(30) Foreign Application Priority Data

Dec. 30, 1997 (SE) ..... 9704908-4

(51) Int. Cl.[7] ..... D21F 11/00; D21F 3/02

(52) U.S. Cl. ..... 162/109; 162/113; 162/117; 162/204; 162/206; 34/398; 34/445

(58) Field of Search ..... 162/109, 111, 162/113, 117, 204–207, 281–282; 34/398, 445, 424, 406, 411, 442, 443; 156/183; 264/282–284

(56) References Cited

U.S. PATENT DOCUMENTS

| | | | | |
|---|---|---|---|---|
| 1,548,783 A | * | 8/1925 | Lorenz | 162/282 |
| 1,548,788 A | * | 8/1925 | Lorenz | 162/282 |
| 1,548,789 A | * | 8/1925 | Lorenz | 162/282 |
| 1,550,084 A | * | 8/1925 | Lorenz | 162/282 |
| 1,582,839 A | * | 4/1926 | Lorenz | 162/282 |
| 3,301,746 A | | 1/1967 | Sandford et al. | 162/113 |
| 4,720,325 A | * | 1/1988 | Rausing et al. | 162/110 |
| 5,405,500 A | * | 4/1995 | Knight | 162/103 |
| 5,556,509 A | | 9/1996 | Trokhan et al. | 162/111 |
| 5,609,725 A | | 3/1997 | Van Phan | 162/117 |
| 5,736,223 A | * | 4/1998 | Laurent | 428/154 |

FOREIGN PATENT DOCUMENTS

| | | |
|---|---|---|
| EP | 0 409 655 | 6/1992 |
| SE | 423 118 | 4/1982 |

* cited by examiner

*Primary Examiner*—Jose Fortuna
(74) *Attorney, Agent, or Firm*—Burns, Doane, Swecker & Mathis, L.L.P.

(57) ABSTRACT

A process for producing paper having a three-dimensional structure of alternating raised and recessed portions including passing a wet paper web through a heated press nip so the paper web is simultaneously dried by means of impulse drying and given a three dimensional structure. The heated press nip includes a heated pressure roll with a three dimensional pattern of alternating raised and recessed portions in its surface and a compressible surface. The compressible surface can be a compressible press felt which supports the wet paper web prior to and through the heated press nip. The compressible press felt may be pressed against a resilient compressible surface in the heated press nip away from the heated cylinder. The wet paper web may be a papermaking pulp containing at least 10%, and preferably at least 30% or 50% by weight of a high-yield pulp such as TMP or CTMP.

20 Claims, 7 Drawing Sheets

METHOD OF PRODUCING A PAPER HAVING A THREE-DIMENSIONAL PATTERN

This application is a continuation application of PCT/SE98/02461, which designated the United States of America. This application claims priority under 35 U.S.C. §§119 and/or 365 to SE 9704908-4 filed in Sweden on Dec. 30, 1997. The entire contents of PCT/SE98/02461 and SE 9704908-4 are hereby incorporated herein by reference.

TECHNICAL FIELD

Method of producing a paper having a three-dimensional pattern of alternating raised and recessed portions which is given the paper in connection with impulse drying, at which the wet paper web is passed through a press nip comprising a rotatable roll which is heated and is provided with a pattern of alternating raised and recessed portions intended to be pressed into the paper web against a holder-on.

BACKGROUND OF THE INVENTION

Moist paper webs are usually dried against one or more heated rolls. A method which is commonly used for tissue paper is so called yankee drying. At yankee drying the moist paper web is pressed against a steam-heated yankee cylinder, which can have a very large diameter. Further heat for drying is supplied by blowing of heated air. If the paper to be produced is soft paper the paper web is usually creped against the yankee cylinder. The drying against the yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the through-air-dryer is then only vacuum dewatered and has a dry content of about 25–30% and is dried in the through-air-dryer to a dry content of about 65–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the patterned structure of the drying fabric is transferred to the paper web. This structure is essentially maintained also in wet condition of the paper, since it has been imparted to the wet paper web. A description of the TAD technique can be found in e g U.S. Pat. No. 3,301,746.

Impulse drying of a paper web is disclosed in e g SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is e g accomplished by gas burners or other heating devices, e g by means of electromagnetic induction. By the fact that the heat transfer to the paper mainly occurs in a press nip an extraordinarily high heat transfer speed is obtained. All water that is removed from the paper web during the impulse drying is not evaporated, but the steam on its way through the paper web carries along water from the pores between the fibers in the paper web. The drying efficiency becomes by this very high.

In EP-A- 0 490 655 there is disclosed the production of a paper web, especially soft paper, where the paper simultaneously with impulse drying is given an embossed surface. This embossment is made by pressing a pattern into the paper from one or both sides against a hard holder-on. This gives a compression of the paper and by this a higher density in certain portions just opposite the impressions and a lower density in the intermediate portions.

THE OBJECT AND MOST IMPORTANT FEATURES OF THE INVENTION

The object of the present invention is to provide a method of producing an impulse dried paper having a three-dimensional pattern, e g a soft paper intended as toilet paper, kitchen rolls, paper handkerchiefs, table napkins and the like, and where the paper has a high bulk, high elasticitity and a high softness. The wet paper web is in connection with impulse drying passed through a press nip comprising a rotatable roll which is heated and is provided with a pattern of alternating raised and resessed portions intended to be pressed into the paper web against a holder-on. The novel feature according to the invention is that the holder-on has a non-rigid (compressible) surface so that the paper web is given a three-dimensional structure which has a total thickness which is greater than the thickness of the unpressed paper web. By this the bulk and softness of the paper as well as the elasticity thereof are improved.

The paper web is preferably supported by a compressible press felt through the press nip, said press felt forming the non-rigid holder-on. According to one embodiment the press felt is pressed against a resilient non-rigid surface in the press nip.

DESCRIPTION OF THE DRAWINGS

The invention will in the following be closer described with reference to some embodiments shown in the accompanying drawings.

DESCRIPTION OF THE INVENTION

Figure 1:
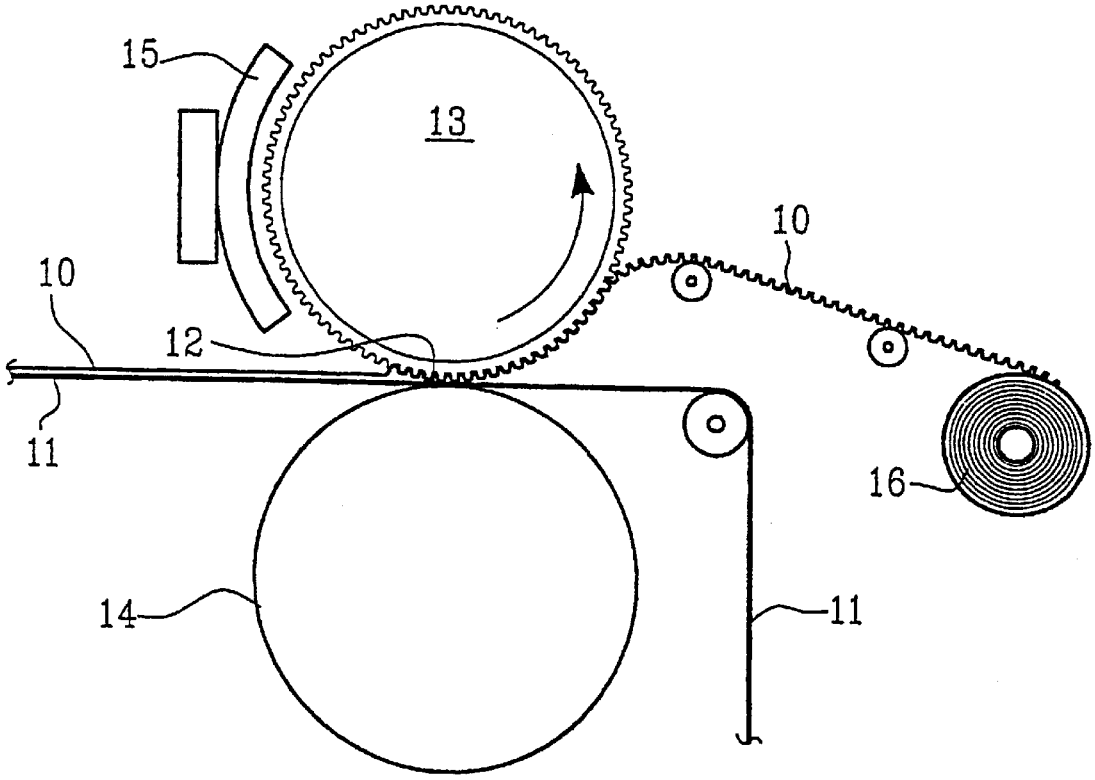
FIG. 1 is a schematic side view of an impulse drying device according to one embodiment.

FIG. 1 shows schematically a device for performing impulse drying of a paper web. The wet paper web 10 which is dewatered over suction boxes (not shown) is supported by a compressible press felt 11 and is brought into a press nip 12 between two rotatable rolls 13 and 14, at which the roll 13 which is in contact with the paper web is heated to a temperature which is sufficiently high for providing drying of the paper web. The surface temperature of the heated roll can vary depending on such factors as the moisture content of the paper web, thickness of the paper web, the contact time between the paper web and the roll and the desired moisure content of the completed paper web. The surface temperature should of course not be so high the the paper web is damaged.

An appropriate temperature should be in the interval 100–400° C., preferably 150–350° C. and most preferably 200–350° C.

The paper web is pressed against the heated roll 13 by means of the felt 11 and the roll 14, which is provided with a soft non-rigid (compressible) surface layer, e g rubber or another resilient material.

A very rapid, violent and almost explosive stream generation takes place in the interface between the heated roll 13 and the moist paper web, at which the generated steam on its way through the paper web carries away water. For a further description of the impulse drying technique reference is made to the above mentioned SE-B-423 188 and e.g.to EP-A-0 337 973 and U.S. Pat. No. 5,556,511.

The paper is after drying wound on a wind-up roll 16. If desired the paper can be creped before winding. It is however noted that the need for creping the paper in order to impart softness and bulk which is aimed at for soft paper, is reduced when using the impulse drying method according to the invention, since the paper by the strong steam expansion in the paper web is imparted bulk and softness and besides a three-dimensional structure.

The paper web can before it is brought into the impulse dryer either can be only dewatered over suction boxes or besides slightly pressed according to a conventional process.

Figure 2:
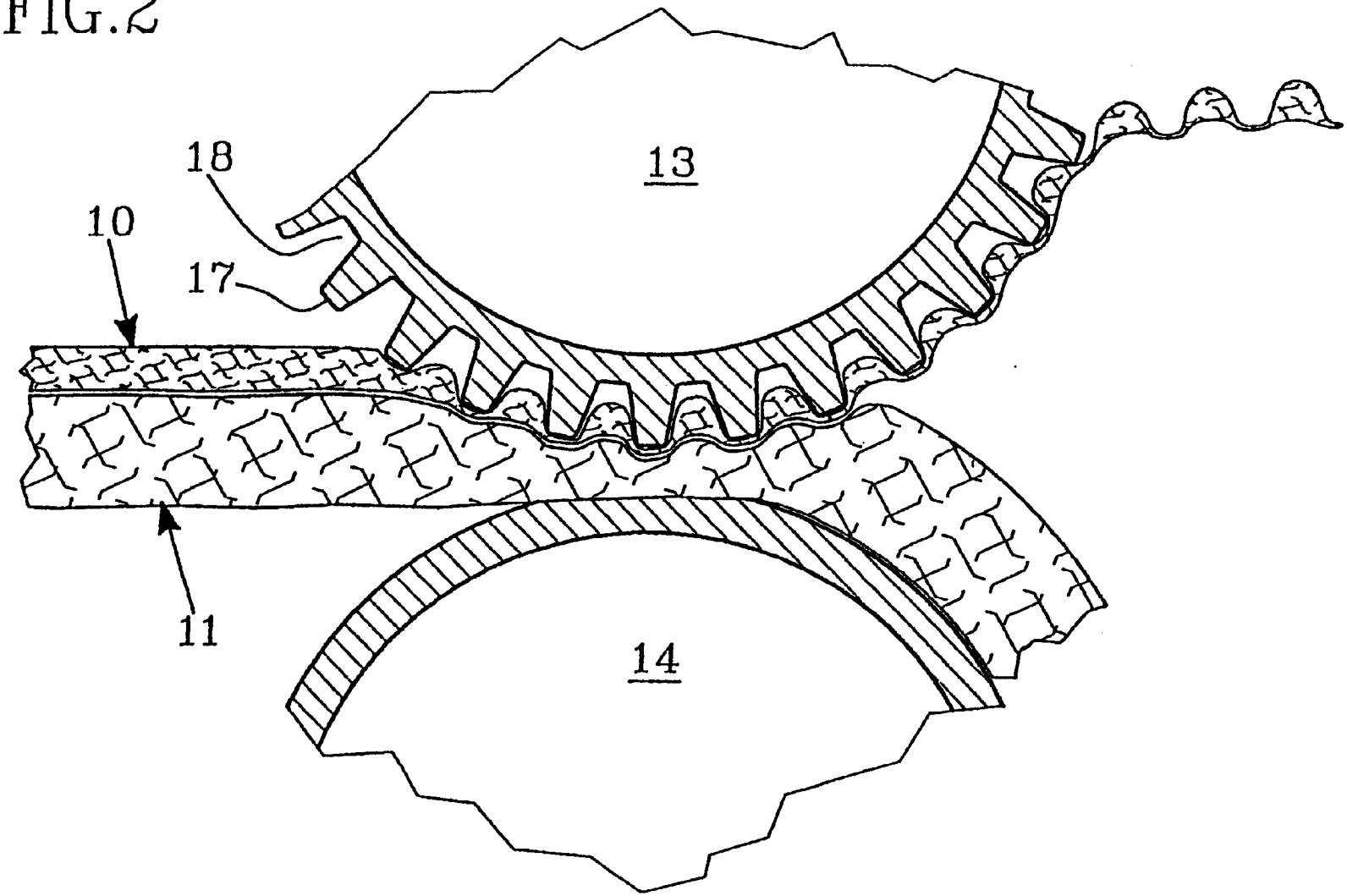
FIG. 2 shows the press nip on a larger scale.
Figure 6:
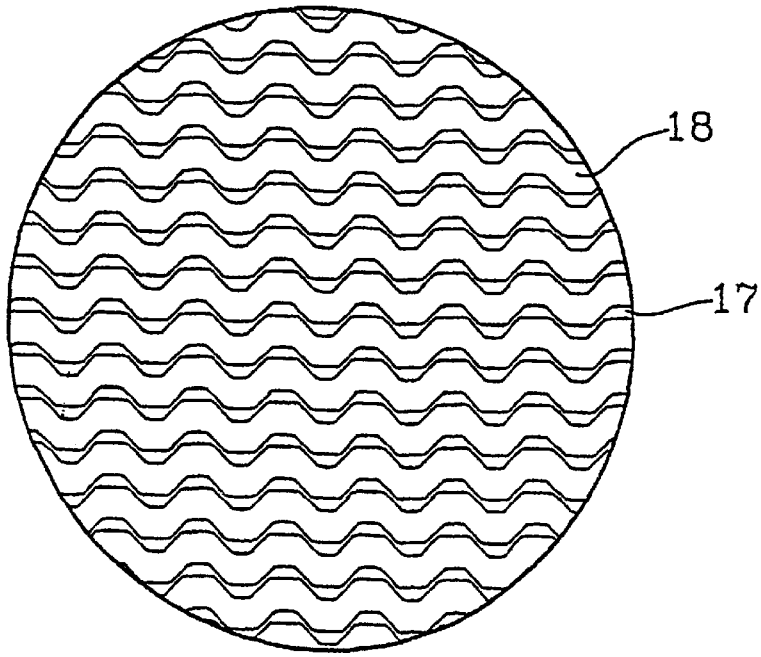
FIG. 6 shows an embossing pattern.

Simultaneously with the impulse drying the paper is given a three-dimensional structure. This can be made as shown in FIGS. 1 and 2 by the fact that the heated roll 13 is provided with an embossing pattern consisting of alternating raised and recessed areas. In FIG. 6 there is shown an example of such an embossing pattern where the raised portions 17 consist of a protruding relief and the recessed portions of milled grooves. This structure is substantially maintained also in a later wetted condition of the paper, since it has been imparted the wet paper web in connection with drying thereof.

Since the term embossing is normally used for a shaping performed on dried paper we have in the following used press moulding for the three-dimensional shaping of the paper that occurs simultaneously with the impulse drying. By this press moulding the bulk and absorption capacity of the paper is increased, at the same time is it imparts for soft paper important properties such as lower tensile stiffness and higher elongation.

By the fact that the press moulding of the paper web takes place against a non-rigid surface, i e the compressible press felt 11 and the rubber-coated envelope surface of the roll 14, a shaping of the paper takes place which results in a three-dimensional structure the total thickness of which is greater than the thickness of the unpressed paper. This is seen from FIG. 2. By this the paper is imparted a high bulk and by that a high absorption capacity and a high softness, which are important properties for soft paper. At the same time a locally varying density is obtained in the paper, where the portions of the paper that are compacted by the raised portions 17 of the roll 12 have a higher density. The three-dimensional structure also contributes to impart to the paper web for soft paper important properties such as lower tensile stiffness and higher elongation.

Figure 3:
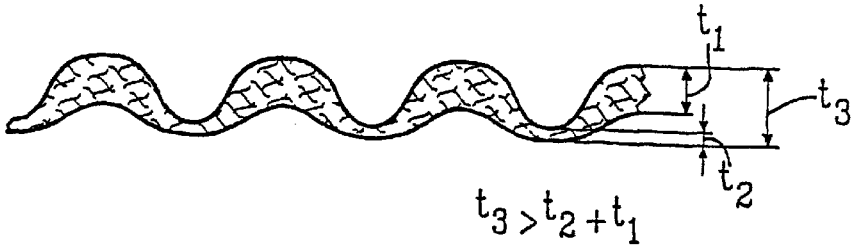
FIG. 3 shows a schematic cross section through a paper according to the invention.

In FIG. 3 there is shown a schematic cross-section through a paper web which has been press moulded according to the invention, at which $t_1$ denotes the thickness of the unpressed paper web, $t_2$ denotes the thickness of the compacted portions of the paper web and $t_3$ is the total thickness of the paper web. In FIG. 3 it is shown that $t_3>t_1+t_2$. It is however not necessary that $t_3>t_1+t_2$, but according to the invention it is sufficient that $t_3>t_1$, at which in certain cases $t_3<t_1+t_2$.

Figure 4:
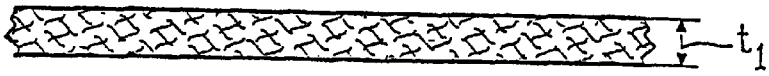
FIG. 4 shows a schematic cross section of the uncompressed paper.
Figure 5:
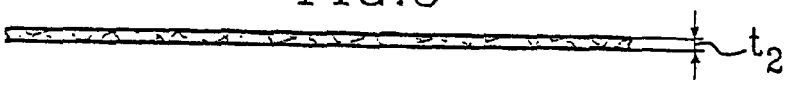
FIG. 5 shows a schematic cross section of the paper if it had been compressed in a press nip where the heated roll had been smooth.

In FIG. 4 there is shown a schematic cross-section through the uncompressed papaer web before the press nip, at which it has the thickness $t_1$. In FIG. 5 there is shown a schematic cross-section through a paper web which has been compressed in a press nip with a smooth heated roll, at which the paper web is compressed to the thickness $t_2$.

The press device can of course be designed in many other ways. The holder-on can for example consist of a press shoe in a resilient cover. Two or more press devices can further be arranged after each other.

Paper can be produced by a number of different pulp types. If one disregards recovery pulp, which today is used to a great extent mainly for toilet paper and kitchen rolls, the most commonly used pulp type for soft paper is chemical pulp. This is produced by impregnating wood chips with chemicals and then boil it so that the lignin and the hemicellulose is transferred to the liquid. After finished boiling the pulp is screened and washed before it is bleached. The lignin content in such pulp is practically zero and the fibers, which mainly consist of pure cellulose, are relatively thin and flexible. Chemical pulp can be both of long- and short fiber type depending on the wooden raw material used, and can be of sulphate- or sulphite type depending on the composition of the boiling liquid. Chemical long fiber pulp (softwood), especially of sulphate type, has a favourable effect on the strength properties of the soft paper, both dry- and wet strength.

Chemical pulp is a low yield pulp since it gives a yield of only about 50% calculated on the wooden raw material used. It is therefore a relatively expensive pulp. It is therefore common to use cheaper so called high yield pulps, e g mechanical or thermomechanical pulp, in soft paper as well as in other types of paper, e g newsprint paper, cardboard etc. Mechanical pulp is produced by grinding or refining and the principle for mechanical pulp production is that the wood is mechanically disintegrated. The entire wood material is utilized and the lignin is thus left in the fibers, which are relatively short and stiff. The production of thermomechanical pulp (TMP) is accomplished by refining in a disc refiner at an increased steam pressure. Also in this case the lignin is left in the fibers.

Chemomechanical pulp (CMP) or chemothermomechanical pulp (CTMP) are terms for a thermomechanical pulp which has been modified by the addition of small amounts of chemicals, usually sulphite, which is added before the refining. One effect of the chemical treatment is that the fibers are freed more easily. A chemomechanical or chemothermomechanical pulp contain more complete fibers and less shives (fiber aggregates and fiber fragments) than a mechanical or thermomechanical pulp. The properties of CMP and CTMP approaches those for the chemical pulps, but there are essential differences depending among other things on that in CMP and CTMP the fibers are coarser and can contain a high amount of lignin, resins and hemicellulose. The lignin and the resins gives the fibers more hydrophobic properties and a reduced ability ro form hydrogen bonds. The addition of a certain amount of chemothermomechanical pulp in soft paper has due to the reduced fiber-fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous-, easily dewatered- and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

The amount of high yield pulp should be at least 10% by weight calculated on the dry fiber weight, preferably at least 30% by weight and most preferably at least 50% by weight. Admixture of a certain amount of other pulp with good strength properties, such as chemical pulp, preferably long-fibrous sulphate pulp, or recovery pulp, is an advantage if a high strength of the finished paper is aimed at.

Common additives such as wet strength agents, softening agents, fillers etc. may of course be used in the paper.

Trials have been made in an experimental equipment in which a paper web having a dry content of about 35% by weight without previous pressing was exerted to impulse drying at temperatures varying between about 200–300° C. and a pressure of about 4 MPa. The impulse drying time was between 3 and 20 msec. The pulp types that were tested were 100% unbeaten chemical sulphate pulp, 100% HT-CTMP and 50/50 unbeaten chemical sulphate pulp/HT-CTMP. The impulse drying was performed with as well as without embossing (press moulding) of the paper web.

Figure 7:
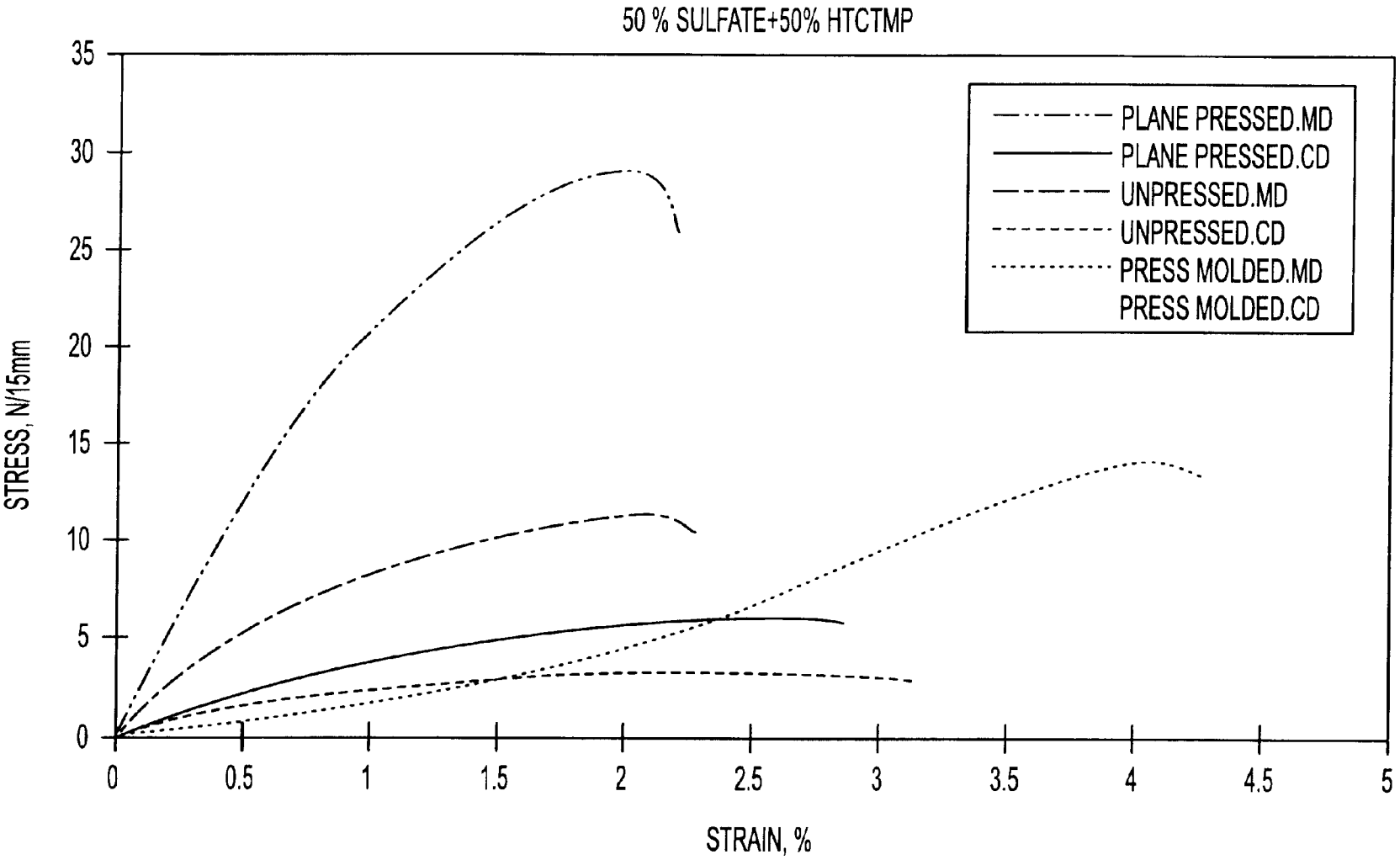
FIG. 7 shows a comparison between a strain-stress diagram for uncompressed (unpressed), compressed (plane pressed) and press moulded paper with the pattern according to FIG. 6.

In FIG. 7 there is shown a comparison between stress-strain diagrams for uncompressed (unpressed) paper, compressed (plane pressed) paper and paper which was press moulded with the pattern shown in FIG. 6. The very good strain properties of the paper that has been press moulded according to the invention can be seen.

Figure 8A:
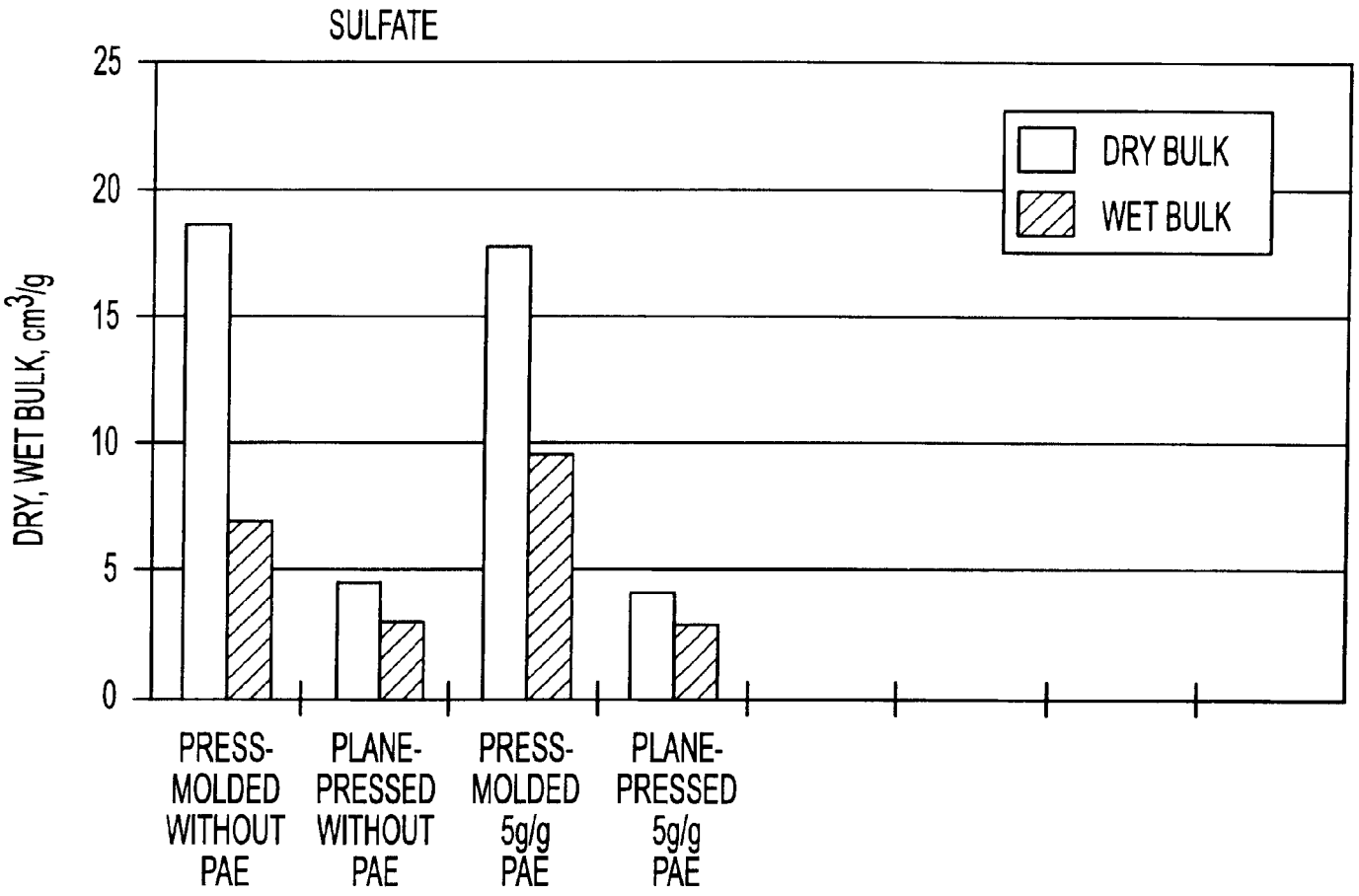
FIGS. 8 *a–c* show in the form of bar charts the bulk and absorption of impulse dried paper produced from different types of pulp.
Figure 8B:
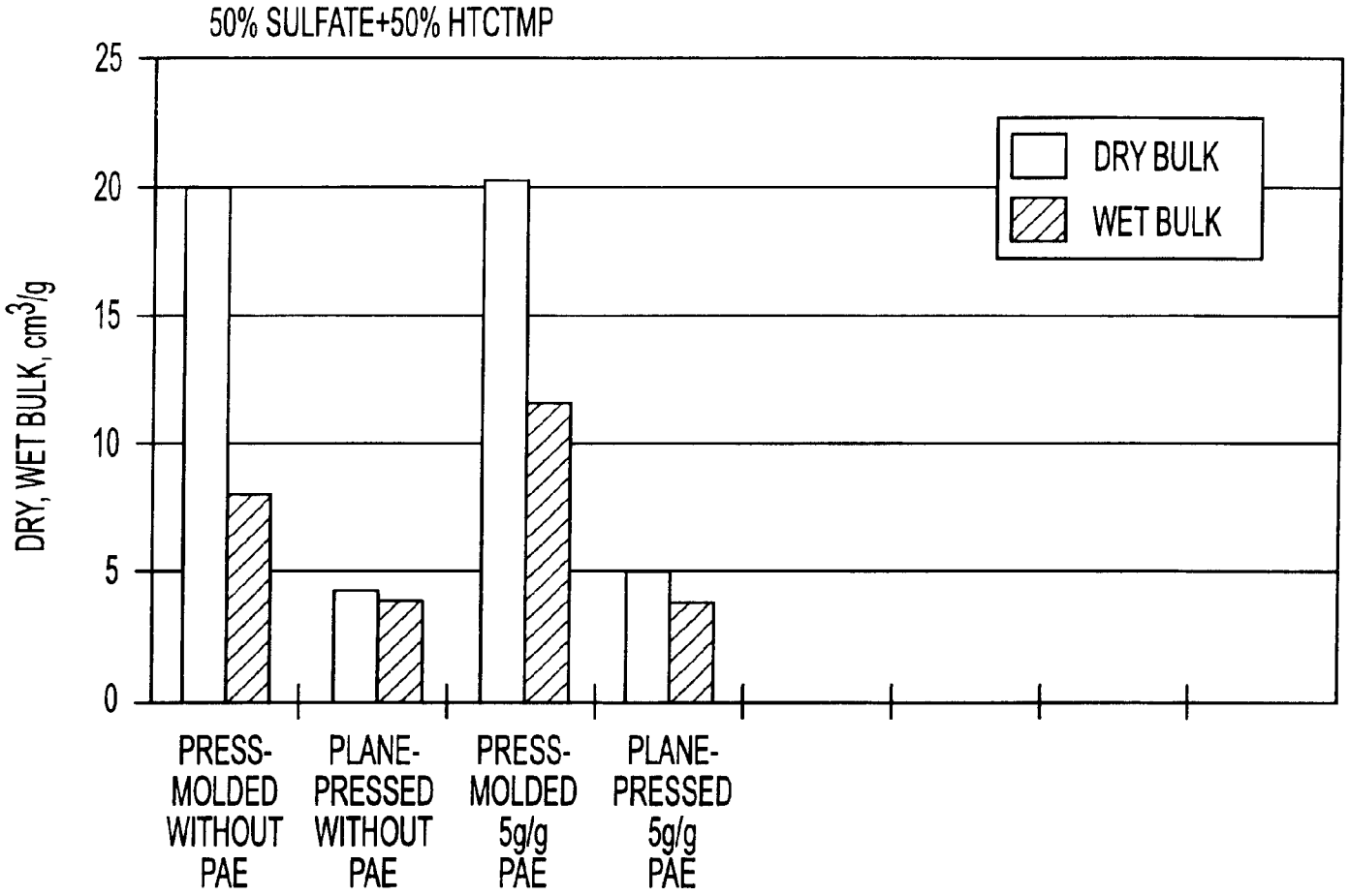
Figure 8C:
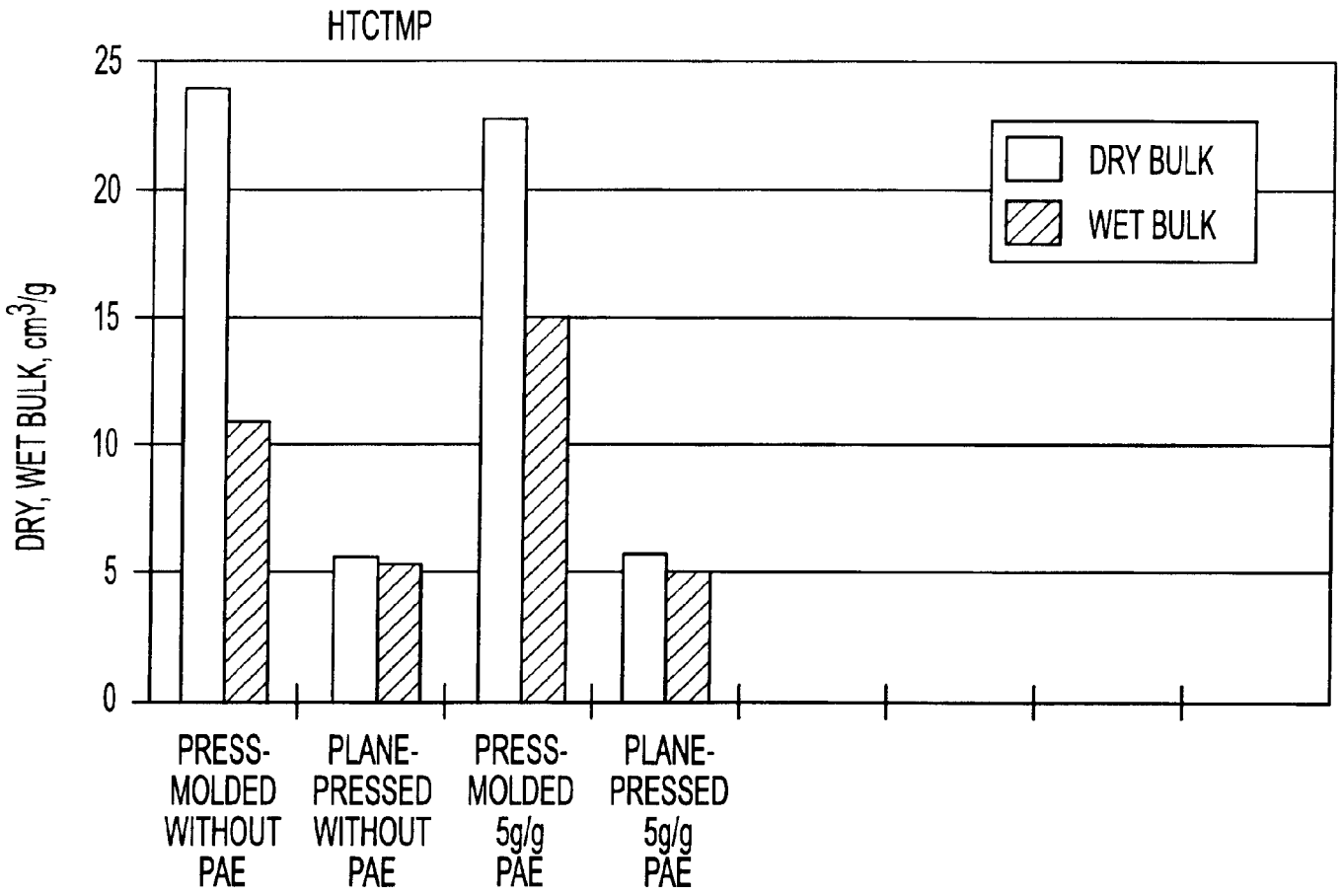

In FIGS. 8 *a–c* the results of measurments performed with respect to dry and wet bulk of impulse dried paper containing the above pulps are shown. Measurements have been made on unembossed (plane pressed) as well as on embossed (press moulded) paper. Besides measurements have been made on paper with and without addition of KYMENE®, a polyamide-amine-epichlorhydrine resin (PAE). The wet strength agent should be added to the furnish or to the paper web before press moulding, since it has proved that the wet strength agent contributes in permanenting the three-dimensional structure which has been given the paper in connection with the press moulding. The added amount should be at least 0.05% by weight calculated on the dry fiber weight.

From the results it is seen that impulse dried paper which has been press molded according to the invention has a high dry and wet bulk. Especially good results were obtained for those papers that contained a high yield pulp in the form of HT-CTMP. A clear improvement of the wet bulk was achieved when the paper contained a wet strength agent.

The invention is of course not limited to the embodiments described above and shown in the drawings, but may be varied within the scope of the claims. The lignin containing high yield pulp can as previously mentioned be of many different kinds such as mechanical pulp, thermomechanical, chemomechanical and chemothermomechanical pulp and comprise virgin fibers as well as recovery fibers. The admixture of a certain amount of other pulp with good strength properties, such as chemical pulp, preferably long-fibrous sulphate pulp is an advantage if high strength of the finished paper is aimed at. Also other pulps including recovery pulp can be contained in the paper.

The paper web can after the impulse drying be exerted to different types of treatments which per se are known such as addition of different chemicals, further embossing, lamination etc. Such a treatment may be that the paper web after it has been given the three-dimensional pattern is compressed in a subsequent roll nip which has a temperature which is lower than that of the heated roll, by means of which the paper has been given the three-dimensional pattern. Possibly a further pattern may be pressed into the paper web during this compression. The compression involves a decreased bulk of the paper, which saves space during transport and storing. The deformation of the paper web that takes place during this compression is maintained by means of fiber-to-fiber bonds that are not constant in wet condition. The paper will in contact with water or acqueous liquids recover its three-dimensional structure that was given to it at the impulse drying, at which by the expansion of the paper an increased water absorption capacity is obtained.

What is claimed is:

1. A process for producing paper having a three dimensional structure of alternating raised and recessed portions, said process comprising the steps of:

providing a wet paper web;

providing a heated pressure roll having a surface with a three-dimensional pattern of alternating raised and recessed portions;

providing a compressible surface which, together with said heated pressure roll, constitutes a heated press nip capable of performing impulse drying;

passing said wet paper web through said heated press nip whereby said paper web is simultaneously dried by means of impulse drying and given a three-dimensional structure.

2. The process according to claim 1, wherein the compressible surface is a compressible press felt for supporting the wet paper web prior to and through the heated press nip.

3. The process according to claim 2, comprising:

providing a resilient, compressible surface in the heated press nip; and pressing the compressible press felt against the resilient, compressible non-rigid surface in the heated press nip away from the heated cylinder.

4. The process according to claim 1, wherein the wet paper web comprises:

a papermaking pulp containing at least 10% by weight, calculated on the dry fibre weight, of a high yield pulp.

5. The process according to claim 4, wherein the high yield pulp consists of mechanical pulp, thermomechanical pulp, or chemothermomechanical pulp.

6. The process according to claim 4, wherein the high yield pulp is chemothermomechanical pulp.

7. The process according to claim 4, wherein the wet paper web comprises:

a papermaking pulp containing at least 30% by weight, calculated on the dry fibre weight, of a high yield pulp.

8. The process according to claim 7, wherein the high yield pulp consists of mechanical pulp, thermomechanical pulp, or chemothermomechanical pulp.

9. The process according to claim 8, wherein the high yield pulp is chemothermomechanical pulp.

10. The process according to claim 4, wherein the wet paper web comprises:

a papermaking pulp containing at least 50% by weight, calculated on the dry fibre weight, of a high yield pulp.

11. The process according to claim 10, wherein the high yield pulp consists of mechanical pulp, thermomechanical pulp, or chemothermomechanical pulp.

12. The process according to claim 11, wherein the high yield pulp is chemothermomechanical pulp.

13. The process according to claim 1, further comprising the step of:

adding a wet strength agent to the paper web.

14. The process according to claim 13, wherein said adding a wet strength agent includes adding an amount of wet strength agent corresponding to at least 0.05% by weight calculated on the dry fibre weight.

15. A process for producing paper having a three dimensional structure of alternating raised and recessed portions, said process comprising the steps of:

providing a wet paper web;

providing a heated pressure roll having a surface with a three-dimensional pattern of alternating raised and recessed portions;

providing a compressible surface which, together with said heated pressure roll, constitutes a heated press nip capable of performing impulse drying;

passing said wet paper web through said heated press nip whereby said paper web is simultaneously dried by means of impulse drying and given a three-dimensional structure;

said impulse drying generating steam, the steam carrying water away from the paper web as the steam passes through the paper web.

16. A process according to claim 15, wherein said providing a heated pressure roll comprises:

providing a pressure roll with a temperature in the interval 100° and 400° C.

17. A process according to claim 16, wherein said providing a heated pressure roll comprises:

providing a pressure roll with a temperature in the interval 150° and 350° C.

18. A process according to claim 17, wherein said providing a heated pressure roll comprises:

providing a pressure roll with a temperature in the interval 200° and 350° C.

19. A process for producing paper having a three dimensional structure of alternating raised and recessed portions, said process comprising the steps of:

providing a wet paper web;

providing a heated pressure roll having a surface with a three-dimensional pattern of alternating raised and recessed portions;

providing a compressible surface, which, together with said heated pressure roll, constitutes a heated press nip capable of performing impulse drying;

passing said wet paper web through said heated press nip whereby said paper web is simultaneously dried by means of impulse drying and given a three-dimensional structure which has a total thickness which is greater than the thickness of the unpressed paper web.

20. A process for producing paper having a three dimensional structure of alternating raised and recessed portions, said process comprising the steps of:

providing a wet paper web;

providing a heated pressure roll having a surface with a three-dimensional pattern of alternating raised and recessed portions;

providing a compressible surface which, together with said heated pressure roll, constitutes a heated press nip capable of performing impulse drying;

passing said wet paper web through said heated press nip whereby said paper web is simultaneously dried by means of impulse drying and given a three-dimensional structure which is suitable for the production of absorbent, soft paper.

* * * * *